US008487223B2

(12) United States Patent
Kimrey, Jr.

(10) Patent No.: US 8,487,223 B2
(45) **Date of Patent: *Jul. 16, 2013**

(54) MICROWAVE REACTOR HAVING A SLOTTED ARRAY WAVEGUIDE

(75) Inventor: Harold D. Kimrey, Jr., Knoxville, TN (US)

(73) Assignee: Eastman Chemical Company, Kingsport, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/524,239

(22) Filed: Sep. 21, 2006

(65) Prior Publication Data

US 2007/0079522 A1 Apr. 12, 2007

Related U.S. Application Data

(60) Provisional application No. 60/719,179, filed on Sep. 22, 2005.

(51) Int. Cl.

| | |
|---|---|
| ***H05B 6/68*** | (2006.01) |
| ***H05B 6/70*** | (2006.01) |
| ***F26B 21/06*** | (2006.01) |
| ***B05C 13/02*** | (2006.01) |

(52) U.S. Cl.
USPC ..... 219/690; 219/696; 34/79; 118/500

(58) Field of Classification Search
USPC ..... 219/690, 691, 693, 694, 695, 707, 219/746, 750, 700; 118/500, 723 MR, 723 ME; 34/79, 412, 259, 265, 264; 343/771, 770
See application file for complete search history.

(56) References Cited

U.S. PATENT DOCUMENTS

| | | | | |
|---|---|---|---|---|
| 2,820,127 A | | 1/1958 | Argento et al. | |
| 2,909,635 A | | 10/1959 | Haagensen | |
| 3,263,052 A | * | 7/1966 | Jeppson et. al. | 219/700 |
| 3,328,800 A | * | 6/1967 | Algeo | 343/768 |
| 3,446,929 A | | 5/1969 | Smith | |
| 3,848,106 A | | 11/1974 | Berggren et al. | |

(Continued)

FOREIGN PATENT DOCUMENTS

| | | |
|---|---|---|
| DE | 4008770 A1 | 9/1991 |
| GB | 2 071 833 A | 9/1981 |

(Continued)

OTHER PUBLICATIONS

International Search Report for PCT/US2006/036799 dated Sep. 21, 2006 (8 pages).

(Continued)

*Primary Examiner* — Quang Van
(74) *Attorney, Agent, or Firm* — William K. McGreevey

(57) ABSTRACT

A system for heating materials, such as wood products, is provided. The system may include waveguide having one or more slots along a longitudinal axis of the waveguide. The slots may be slanted at an angle with respect to the longitudinal axis and spaced at an interval of about one half of a wavelength along the longitudinal axis. The system may further include windows covering the slots. The windows may serve as a barrier. Moreover, the windows may allow electromagnetic energy to be transferred from the waveguide to the material being heated. The waveguide and window may be contained in a microwave reactor to heat materials, such as wood products.

24 Claims, 5 Drawing Sheets

U.S. PATENT DOCUMENTS

| | | | | |
|---|---|---|---|---|
| 3,916,137 | A | 10/1975 | Jurgensen | |
| 4,027,133 | A | 5/1977 | Dygve et al. | |
| 4,247,858 | A * | 1/1981 | Eichweber | 343/729 |
| 4,626,640 | A | 12/1986 | van der Heijden | |
| 4,728,910 | A | 3/1988 | Owens | |
| 4,771,153 | A | 9/1988 | Fukushima et al. | |
| 4,777,336 | A | 10/1988 | Asmussen | |
| 4,851,788 | A | 7/1989 | Ives et al. | |
| 5,075,131 | A | 12/1991 | Hattori et al. | |
| 5,107,602 | A | 4/1992 | Lööf | |
| 5,541,612 | A * | 7/1996 | Josefsson | 343/771 |
| 5,610,567 | A | 3/1997 | Phillips et al. | |
| 5,638,079 | A | 6/1997 | Kastner et al. | |
| 5,714,920 | A | 2/1998 | Ivanov et al. | |
| 5,834,744 | A | 11/1998 | Risman | |
| 5,834,746 | A | 11/1998 | Pedersen et al. | |
| 5,843,236 | A | 12/1998 | Yoshiki et al. | |
| 5,869,817 | A | 2/1999 | Zietlow et al. | |
| 5,892,208 | A | 4/1999 | Harris et al. | |
| 5,970,624 | A | 10/1999 | Moriya | |
| 6,072,167 | A | 6/2000 | Lewis et al. | |
| 6,081,241 | A | 6/2000 | Josefsson et al. | |
| 6,121,595 | A | 9/2000 | Lewis et al. | |
| 6,204,606 | B1 | 3/2001 | Spence et al. | |
| 6,246,039 | B1 | 6/2001 | Omori et al. | |
| 6,333,496 | B1 | 12/2001 | Risman et al. | |
| 6,546,646 | B1 | 4/2003 | Thomas | |
| 6,675,495 | B2 | 1/2004 | Dedieu et al. | |
| 6,797,929 | B2 | 9/2004 | Drozd et al. | |
| 6,833,537 | B2 * | 12/2004 | Risman et al. | 219/690 |
| 6,870,123 | B2 | 3/2005 | Suzuki et al. | |
| 6,903,557 | B2 | 6/2005 | Holmes et al. | |
| 6,933,482 | B2 | 8/2005 | Fagrell et al. | |
| 7,122,772 | B2 | 10/2006 | Feher et al. | |
| 7,256,665 | B2 | 8/2007 | Harris | |
| 7,300,705 | B2 | 11/2007 | Neogi et al. | |
| 7,518,092 | B2 | 4/2009 | Purta et al. | |
| 7,666,235 | B2 | 2/2010 | Learey et al. | |
| 7,846,295 | B1 | 12/2010 | Medoff | |
| 2001/0029942 | A1 | 10/2001 | Champion | |
| 2004/0008943 | A1 | 1/2004 | Berini | |
| 2010/0000110 | A1 | 1/2010 | Li | |
| 2010/0331531 | A1 | 12/2010 | Mykytka | |
| 2011/0091736 | A1 | 4/2011 | Felty, Jr. et al. | |

FOREIGN PATENT DOCUMENTS

| | | | |
|---|---|---|---|
| JP | 1222060 | A | 9/1989 |
| RU | 2057404 | | 3/1996 |
| RU | 2 133 933 | C1 | 7/1999 |
| WO | WO 98/01497 | | 1/1998 |
| WO | WO 2009/040656 | A2 | 4/2009 |
| WO | WO 2009/095687 | A1 | 8/2009 |
| WO | WO 2011/090448 | A1 | 7/2011 |

OTHER PUBLICATIONS

Co-pending U.S. Appl. No. 11/524,261, Kimrey, filed Sep. 21, 2006; now Publication No. 2007-0079523.

Office Action notification date Mar. 3, 2011 received in co-pending U.S. Appl. No. 11/524,261.

Leonelli, Cristina and Mason, Timothy J.; "Chemical Engineering and Processing: Process Intensification"; Chemical Engineering and Processing, 49 (2010) pp. 885-900.

Brelid, P. Larsson; Simonson, R. and Risman, P. 0.; "Acetylation of Solid Wood Using Microwave Heating, Part 1. Studies of Dielectric Properties"; Holz als Roh und Werkstoff; 57, pp. 259-263; (1999).

Brelid, P. Larsson and Simonson, R.; "Acetylation of Solid Wood Using Microwave Heating, Part 2. Experiments in Laboratory Scale"; Holz als Roh-und Werkstoff; 57, pp. 383-389; (1999).

International Search Report for PCT/US2006/036798 dated May 28, 2008.

Notification of Transmittal of the International Search Report and the Written Opinion of the International Searching Authority, or the Declaration date of mailing Sep. 14, 2012 received in International Patent Application No. PCT/US2011/065756.

Daian, M.; Doctoral Thesis: "The Development and Evaluation of New Microwave Equipment and its Suitability for Wood Modification"; Industrial Research Institute Swinburne; Swinburne University of Technology; 2006 retrieved online at researchbank.swinburne.edu.au.

Hansson, L; Doctoral Thesis: "Microwave Treatment of Wood"; Lulea University of Technology (LTU), Division of Wood Physics, 2007.

International Search Report for PCT/US2006/036798 dated May 28, 2008 (11 pages).

* cited by examiner

MICROWAVE REACTOR HAVING A SLOTTED ARRAY WAVEGUIDE

CROSS REFERENCE TO RELATED APPLICATION

This application claims the benefit of U.S. Provisional Patent Application No. 60/719,179, entitled "MICROWAVE REACTOR HAVING A SLOTTED ARRAY WAVEGUIDE," filed on Sep. 22, 2005, the entire disclosure of which is expressly incorporated herein by reference.

TECHNICAL FIELD

The present invention generally relates to a microwave reactor and, more particularly, to a microwave reactor having a slotted array waveguide for heating.

BACKGROUND

Wood is used in many applications that expose the wood to decay, fungi, or insects. To protect the wood, one alternative is to use traditional wood impregnation approaches, such as pressure treatment chemicals and processes. An alternative approach is to chemically modify the wood by reacting the wood with acetic anhydride and/or acetic acid. This type of modification is referred to as acetylation. Acetylation makes wood more resistant to decay, fungi, and insects.

Acetylation may be performed by first evacuating and then soaking the wood product in acetic anhydride, then heating it with optional pressure to cause a chemical reaction. Ideally, acetylation of wood products, such as planks, studs, and deck materials, would allow for large amounts of wood to be rapidly impregnated with the acetic anhydride. As such, any heating of wood products during acetylation would also ideally accommodate large quantities of wood products (e.g., bundles of boards). It would also be desirable to heat the wood products during acetylation evenly throughout the wood—thereby providing uniform modification of the wood and minimizing any damage to the wood caused by overheating due to hot spot formation. Thus, there is a need for improved mechanisms for heating wood products to facilitate acetylation.

SUMMARY

Systems and methods consistent with the present invention provide a microwave reactor having a slotted array waveguide for heating. Moreover, the systems and methods may provide heat for materials during a chemical process, such as acetylation.

In one exemplary embodiment, there is provided a system for heating. The system includes a waveguide having slots along a longitudinal axis of the waveguide, the slots being slanted at an angle with respect to the longitudinal axis and spaced at an interval of about one half of a wavelength along the longitudinal axis. Moreover, the system includes a window covering each of the slots, the window serving as a barrier and allowing electromagnetic energy to be transferred from the waveguide to the material being heated.

In another embodiment, there is provided a system for heating a material. The system includes a chamber sized to accommodate the material and a waveguide, the waveguide having one or more slots along a longitudinal axis of the waveguide, the slots being slanted at an angle with respect to the longitudinal axis and spaced at an interval of about one half of a wavelength along the longitudinal axis. The system also includes a window covering each of the one or more slots, the window serving as a barrier and allowing electromagnetic energy to be transferred from the waveguide to the material.

It is to be understood that both the foregoing general description and the following detailed description are exemplary and explanatory only and are not restrictive of the invention, as described. Further features and/or variations may be provided in addition to those set forth herein. For example, the present invention may be directed to various combinations and subcombinations of the disclosed features and/or combinations and subcombinations of several further features disclosed below in the detailed description.

DESCRIPTION OF THE DRAWINGS

The accompanying drawings, which constitute a part of this specification, illustrate various embodiments and aspects of the present invention and, together with the description, explain the principles of the invention. In the drawings.

DETAILED DESCRIPTION

Reference will now be made in detail to the invention, examples of which are illustrated in the accompanying drawings. The implementations set forth in the following description do not represent all implementations consistent with the claimed invention. Instead, they are merely some examples consistent with certain aspects related to the invention. Wherever possible, the same reference numbers will be used throughout the drawings to refer to the same or like parts.

In one embodiment consistent with the present invention, energy from a slotted array waveguide may be used as a source of heat. A slotted array waveguide is a waveguide with a plurality of slots serving as an opening to transmit electromagnetic energy, such as microwave energy. In some embodiments, the slotted array waveguide heats a material, such as wood. For example, in one embodiment, the slotted array waveguide provides heat for a chemical process, such as the acetylation of a wood product.

Microwave energy from a slotted array waveguide may be used as a source of heat for the modification of a wood product by acetic anhydride. To acetylate wood, in one embodiment, the wood product is first placed in a chamber (also known as a reactor) containing the slotted array waveguide. The slotted array waveguide may provide random, near-field heating of the wood product. Moreover, the slotted array waveguide and chamber may facilitate even heating of the wood product—enhancing acetylation and avoiding damage to the wood caused by overheating.

The acetylation process of the wood may first include pulling a vacuum on a chamber to remove air from the wood, filling the chamber with acetic anhydride, and then applying pressure to impregnate the wood product with the acetic anhydride. Next, the chamber may be drained of the excess liquid. The chamber containing the wood product may then be repressurized and heated using the slotted array waveguide. A heating phase may heat the wood product to a temperature range of, for example, about 80 degrees Celsius to about 170 degrees Celsius. The heating phase may be for a time period of, for example, about two minutes to about one hour. During the heating phase, a chemical reaction occurs in the wood product that converts hydroxyl groups in the wood to acetyl groups. By-products of this chemical reaction include water and acetic acid. When the heating phase is complete, the chamber may be put under a partial pressure and heated to remove any unreacted acetic anhydride and by-products. Although the above described an example of an acetylation process, other chemical processes may be used.

Figure 1:
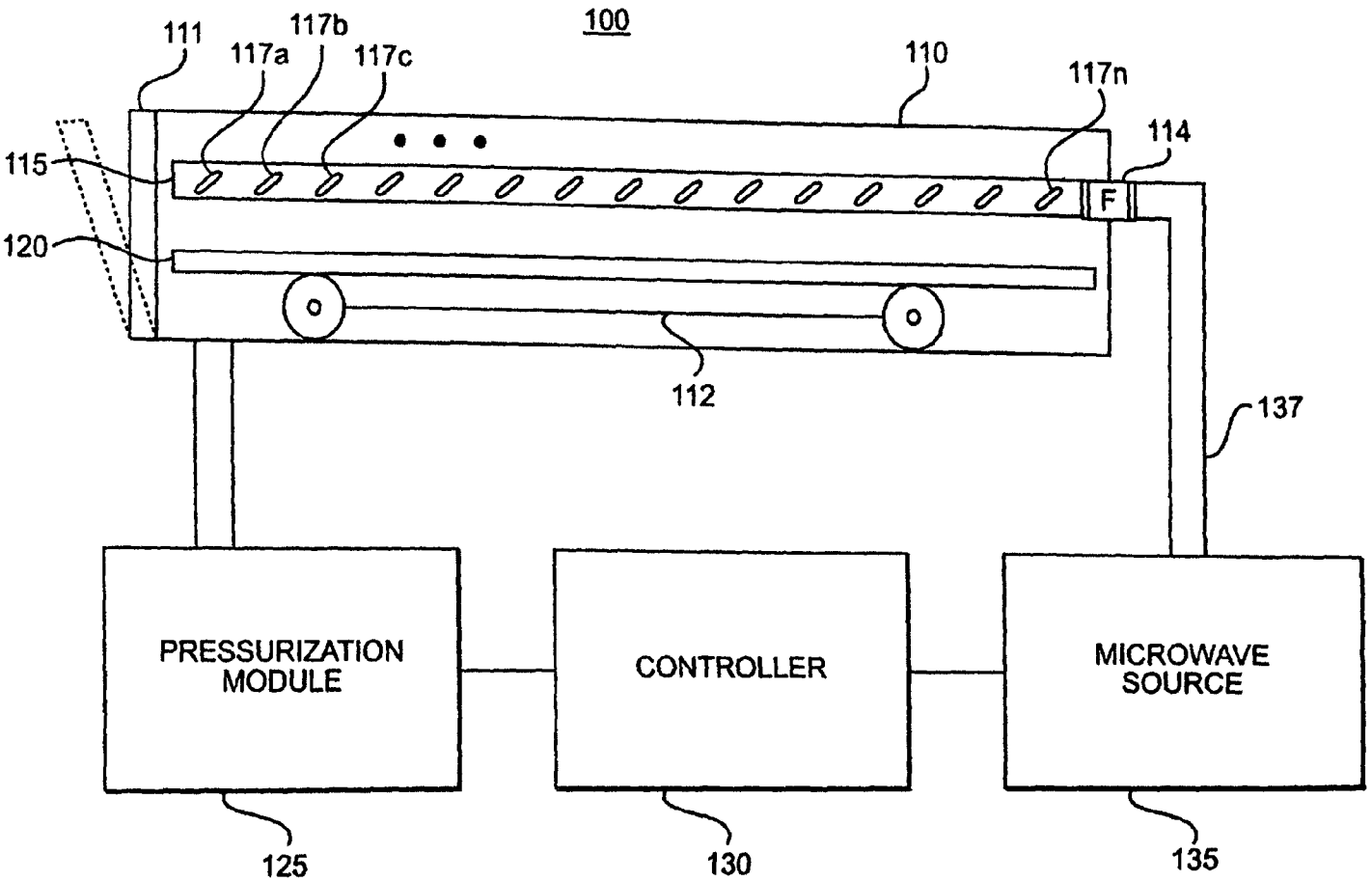
FIG. 1 is a block diagram of an exemplary microwave reactor having a slotted array waveguide in a system consistent with the present invention.

An example of a system for heating is depicted at FIG. 1. As shown, system 100 includes a pressurized chamber 110. Pressurized chamber 110 contains a slotted array waveguide 115 having slots 117*a-n*, a material 120, such as a wood product, and a carrier 112. Slotted array waveguide 115 is coupled to a flange (labeled "F") 114, which is coupled to chamber 110 and to a coupling waveguide 137. Coupling waveguide 137 is coupled to a microwave source 135, allowing electromagnetic energy from source 135 to be transmitted to slotted array waveguide 115. A controller 130 is used to control microwave source 135 and to control a pressurization module 125, which pressurizes chamber 110.

The following description refers to material 120 as a wood product 120, although other materials may be heated by system 100. Wood product 120 may be placed on carrier 112 and then be inserted into chamber 110 through a chamber door 111. When chamber door 111 is sealed shut, chamber 110 may be evacuated and then supplied with a chemical, such as an acetic anhydride and/or acetic acid, for treating the wood product 120. Pressurized chamber 110 is a reactor that can be pressurized to 30-150 pounds per square inch to facilitate the impregnation rate of wood product 120. Although chamber 110 is described as a pressurized chamber, in some applications, chamber 110 may not be pressurized. Moreover, processes other than acetylation may be used to treat the wood.

Controller 130 may initiate heating by controlling microwave source 135 to provide energy for heating. Microwave source 135 provides energy to slotted array waveguide 115 through waveguide 137. After chamber 110 is supplied with a chemical, such as acetic anhydride, and drained, controller 130 may heat wood product 120 to one or more predetermined temperatures. Moreover, controller 130 may also control the time associated with the heating of wood product 120. For example, controller 130 may control microwave source 135 to provide energy to slotted array waveguide 115, such that the temperature of wood product 120 is held above about 90 degrees Celsius for about 30 minutes. After wood product 120 has been heated to an appropriate temperature and acetylation of wood product 120 is sufficient, any remaining chemicals, such as acetic anhydride, may be drained from chamber 110. Next, slotted array waveguide 115 may also dry wood product 120 of any excess chemicals, such as acetic anhydride, and any by-products of the chemical process. Vacuum assisted drying may also be used to drywood product 120. In one embodiment, chamber 110 has a 10-inch diameter and a length of 120 inches, although a other size chambers may be used.

Carrier 112 is a device for holding materials being heated by system 100. For example, carrier 112 may include a platform and wheels to carry wood product 120 into chamber 110. Carrier 112 may also be coated in a material that is resistant and non-reactive to the chemical processes occurring within chamber 110. For example, carrier 112 may be coated in a material such as Teflon™, although other materials may be used to coat carrier 112. Moreover, although carrier 112 is depicted as carrying a single wood product 120, carrier 112 may carry a plurality of wood products.

Wood product 120 may be an object comprising wood. For example, wood product 120 may include products made of any type of wood, such as hardwood species or softwood species. Examples of softwoods include pines, such as loblolly, slash, shortleaf, longleaf, or radiata pine, cedar, hemlock, larch, spruce, fir, and yew, although other types of softwoods may be used. Examples of hardwoods include beech, maple, hickory, oak, ash, aspen, walnut, pecan, cherry, teak, mahogany, chestnut, birch, larch, hazelnut, willow, poplar, elm, eucalyptus, and tupelo, although other types of hardwoods may be used. In some applications involving acetylation of wood, wood product 120 may include, for example, loblolly, slash, shortleaf, longleaf, or radiata pine. Wood products 120 may have a variety of sizes and shapes including, for example, sizes and shapes useable as timbers, lumber, deckboards, veneer, plies, siding boards, flooring, shingles, shakes, strands, sawdust, chips, shavings, wood flour, fibers, and the like.

Slotted array waveguide 115 includes slots 117*a-n* along the longitudinal axis of slotted array waveguide 115. The slots are cut into the walls of slotted array waveguide 115 to allow electromagnetic energy, such as microwaves, to be transmitted from the slots to the material being heated (e.g., wood product 120). FIG. 1 depicts slots 117 as having a somewhat rectangular shape with rounded ends. However, the slots may have other shapes that facilitate transmission of electromagnetic energy from slotted array waveguide 115 and slots 117 to the material being heated.

Slotted array waveguide 115 may be implemented as a metal structure for channeling electromagnetic energy. Slotted array waveguide 115 may generally comprise any appropriate metal, such as stainless steel, copper, aluminum, or beryllium copper. Although FIG. 1 depicts slotted array waveguide 115 as a rectangular waveguide, the cross section of slotted array waveguide 115 may have other shapes (e.g., elliptical) that maintain a dominant modes of transmission and polarization. The walls of the slotted array waveguide 115 are selected to withstand the pressure of chamber 110. In one implementation, the walls of slotted array waveguide 115 may have a thickness between about ¼ inch and ½ inch to withstand the 150 pounds per square inch pressure of chamber 110.

In one embodiment, slotted array waveguide 115 may be implemented as a rectangular $TE_{10}$ mode waveguide, with about a 100-inch length, inner rectangular dimensions of about 1.34 inches by about 2.84 inches, and outer rectangular dimensions of about 2.34 inches by 3.34 inches, although other sizes may be used. In one implementation, slotted array waveguide 115 may be selected to propagate microwave energy at a wavelength of about 122 millimeters ($\lambda$=0.122 meters), which corresponds to about 2.45 Gigahertz, although energy at other wavelengths may be used. Moreover, slotted array waveguide 115 may be implemented with commercially available waveguide, such as standard sizes WR(waveguide, rectangle) 284, WR430, or WR340. Alternatively, slotted array waveguide 115 may be specially fabricated to satisfy the following equations:

$$(\lambda_c)_{mn} = \frac{2}{\sqrt{\frac{m^2}{a} + \frac{n^2}{b}}}, \quad \text{Equation 1}$$

$$(f_c)_{mn} = \frac{1}{2\pi\sqrt{\mu\varepsilon}}\sqrt{\left(\frac{m\pi}{a}\right)^2 + \left(\frac{n\pi}{b}\right)^2}, \quad \text{Equation 2}$$

where a represents the inside width of the waveguide, b represents the inside height of the waveguide, m represents the number of ½-wavelength variations of fields in the "a" direction, n represents the number of ½-wavelength variations of fields in the "b" direction, ϵ represents the permittivity of the waveguide, and μ represents the permeability of the waveguide. When $TE_{10}$ mode waveguide is used, Equations 1 and 2 may reduce to the following equations:

$$(\lambda_c) = 2a, \quad \text{Equation 3}$$

$$(f)_c = \frac{c}{2a}, \quad \text{Equation 4}$$

where c represents the speed of light $$\left(c = \frac{1}{\sqrt{\mu\varepsilon}}\right)$$

n air.

The first slot 117*a* of slotted array waveguide 115 may be positioned about ½ wavelength (λ) from the end of slotted array waveguide 115, where the wavelength (λ) is the operating wavelength of the, slotted array waveguide 115. The next slot 117*b* may be positioned ½ wavelength from slot 117*a*. The remaining slots (e.g., slot 117*c* and so forth to slot 117*n*) may each be positioned at about ½ wavelength intervals along the longitudinal axis of slotted array waveguide 115. The slot interval may also be an integer multiple of the ½ wavelength. Each of the slots may be angled between 0 degrees and 90 degrees. For example, the slots may each be angled at 10 degrees from the longitudinal axis of slotted array waveguide 115.

Slotted array waveguide 115 may be pressurized and filled with a gas, such as nitrogen. Moreover, one end of slotted array waveguide 115 may be terminated with a waveguide short-circuit (or terminated with a waveguide dummy-load circuit), while the other end of slotted array waveguide 115 may be coupled to a flange 114. Each of the slots 117 and the flanged end of slotted array waveguide 115 may be hermetically sealed with a window, described below with respect to FIGS. 4A and 4B. The windows cover slots 117 and flange 114 to serve as a physical barrier, keeping out contaminants while allowing the transmission of electromagnetic energy. If chemicals, such as acetic anhydride, contaminate the interior of slotted array waveguide 115, the electromagnetic properties of slotted array waveguide 115 may break down, such that slotted array waveguide 115 may no longer be able to serve as a heater.

Although slotted array waveguide 115 is described above as pressurized and filled with nitrogen, in some applications, such pressurization and nitrogen fill may not be necessary. For example, when slotted array waveguide 115 is used to only dry a material, such as wood product 120, pressurization of slotted array waveguide 115 (and chamber 110) may not be necessary. Moreover, when slotted array waveguide 115 is used in unpressurized environments, the slots may not be covered with windows.

Slotted array waveguide 115 provides near-field heating of wood product 120. To facilitate near-field heating, slotted array waveguide 115 is placed close to the surface of a material, such as wood product 120. Specifically, the material would be placed in the near-field of slotted array waveguide 115. By using the near-field to heat the material, such as wood product 120, heating may be less affected by variations in the dielectric properties of wood product 120. As such, the use of slotted array waveguide 115 as a near-field heating mechanism may provide more even heating of the material, such as wood product 120, when compared to past approaches.

Flange 114 (labeled "F") may couple slotted array waveguide 115 to the wall of chamber 110 and to waveguide 137. Flange 114 may also seal the end of slotted array waveguide 115 by using a window, as described below with respect to FIGS. 4A and 4B, to serve as a physical barrier between slotted array waveguide 115 and flange 114.

Coupling waveguide 137 may be implemented as a waveguide that couples chamber 110 and slotted array waveguide 115 to microwave source 135. Coupling waveguide 137 may have the same dimensions as slotted array waveguide 115.

Microwave source 135 generates energy in the microwave spectrum. For example, if a bundle of wood products 120, such as a bundle of wood planks, is chemically processed in chamber 110, microwave source 135 may be configured to provide 60 kilowatts of power at 2.45 Gigahertz (a free space wavelength of about 122 millimeters) to slotted array waveguide 115, although other powers and frequencies (wavelengths) may be used. The frequency of source 135 may be scaled to the type and size of the material being heated. For example, when the cross-section of the wood products increases, the frequency of the source 135 may be decreased since lower frequencies may be less absorptive in a wood medium. For example, when an 8 ½ foot diameter by 63 foot length chamber (sized to accommodate a 4 foot by 4 foot by 60 foot bundle of wood) is used, source 135 may provide an output frequency of 915 Megahertz, although other appropriate frequencies may be used based on the circumstances, such as the material being heated, wood cross section size, and spectrum allocations.

Although microwave source 135 is depicted in FIG. 1 as a single microwave source, microwave source 135 may be implemented as a plurality of microwave sources coupled to slotted array waveguide 115 through waveguide(s) 137. When a plurality of microwave sources are used, waveguide switches may be implemented to switch among the plurality of waveguide sources.

Controller 130 may be implemented with a processor, such as a computer, to control microwave source 135. Controller 130 may control the amount of power generated by microwave source 135, the frequency of microwave source 135, and/or the amount of time microwave source 135 is allowed to generate power to slotted array waveguide 115. For example, controller 130 may control the supply of chamber 110 with chemicals, such as acetic anhydride, for treating wood product 120, the subsequent heating of wood product 120 and acetic anhydride, the draining of any remaining acetic anhydride not impregnated into wood product 120, the drying of wood product 120, and the signaling when acetylation is complete.

Controller 130 may also include control mechanisms that respond to temperature and pressure inside chamber 110. For example, when a thermocouple or pressure transducer is placed inside chamber 110, controller 130 may respond to temperature and/or pressure measurements and then adjust the operation of microwave source 135 based on the measurements. Moreover, controller 130 may receive temperature information from sensors placed within the wood. The temperature information may provide feedback to allow control of microwave source 135 during heating and/or drying. Controller 130 may also be responsive to a leak sensor coupled to slotted array waveguide 115. The leak sensor detects leaks from slots 117, which are sealed to avoid contamination from chemicals in chamber 110. When a leak is detected, controller 135 may alert that there is a leak and then initiate termination of heating by slotted array waveguide 115.

Controller 130 may also control pressurization module 125. Pressurization module 125 may control the pressure of chamber 110 based on measurements from a pressure transducer in chamber 110. For example, pressurization module 125 may increase or decrease pressure in chamber 110 to facilitate a chemical process, such as acetylation. Controller 130 may also control other operations related to the acetylation process. Although FIG. 1 depicts pressurization module, in some environments, pressurization module 125 may not be used.

Figure 2:
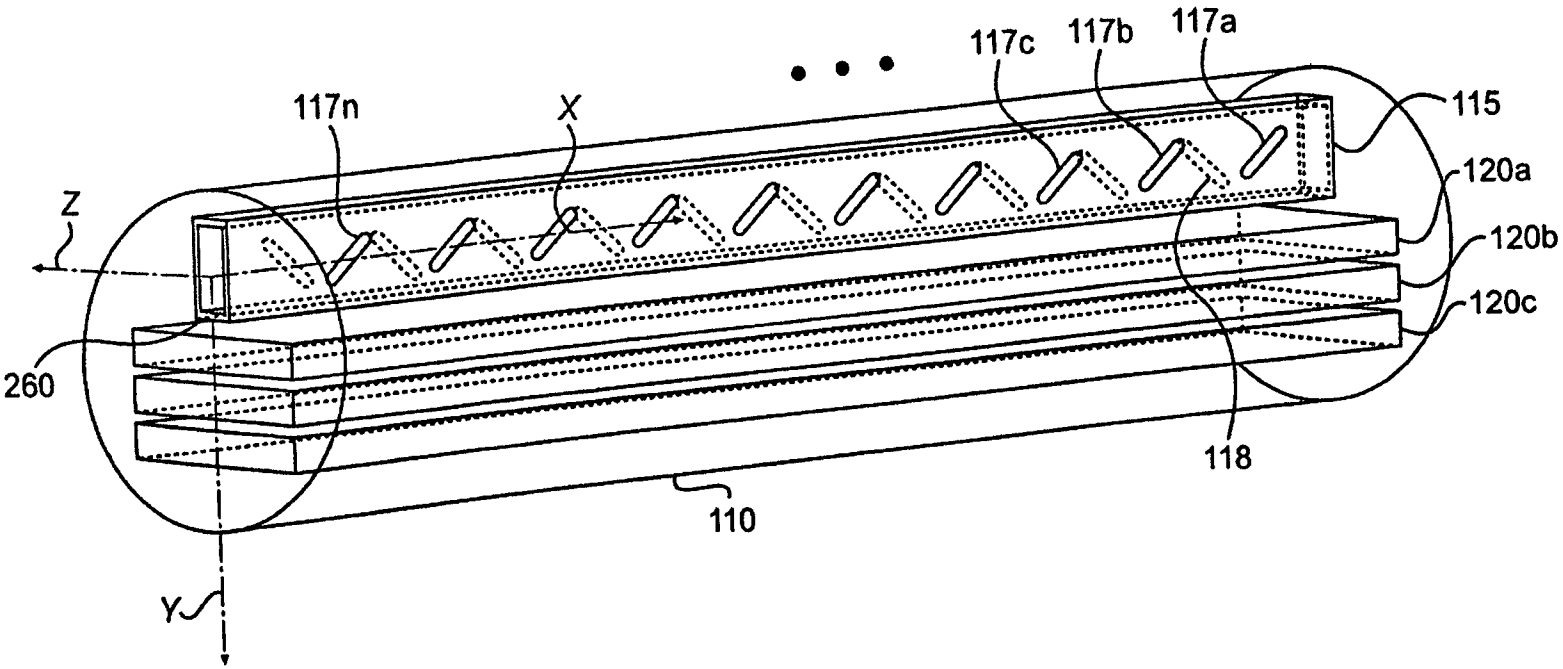
FIG. 2 is a cross section partial perspective view of the reactor of FIG. 1.

FIG. 2 is a cross section partial perspective view of slotted array waveguide 115 and chamber 110. Wood product 120 is depicted as a plurality of wood products 120*a-c*. To facilitate explanation of FIG. 2, the other components contained with chamber 110 are not shown. FIG. 2 depicts slots on alternating sides of slotted array waveguide 115. For example, slots 117 are on one side of slotted array waveguide 115, while the opposite side of slotted array waveguide 115 includes slots 118.

Slots 117*a-n* are each slanted at an angle with respect to the longitudinal axis. The angle determines how much energy is transferred from slotted array waveguide 115 to the material being heated, such as wood products 120*a-c*. For example, a slot at an angle of zero degrees may result in no energy transfer, while an angle between about 50 degrees and about 60 degrees may result in 100% energy transfer. As noted above, the slots may be placed at about ½ wavelength intervals. The angle and placement of slots 117 may be determined using numerical modeling techniques provided by electromagnetic-field simulation and design software, such as HFSS™ (commercially available from Ansoft, Corporation, Pittsburgh, Pa.). The amount of energy for each slot may be approximated based on the following equation:

$$\frac{100\%}{n}, \qquad \text{Equation 5}$$

where n is the number of slots. For example, if slotted array waveguide 115 has five slots, the amount of energy at each slot would be 20%, while the angle to achieve the 20% would be determined using numerical modeling techniques. Although the previous example uses an even distribution of energy among slots, other energy distribution arrangements may be used.

Slots 117 and slots 118 may have the same or different angles with respect to the longitudinal axis of slotted array waveguide 115. Moreover, slot arrangements other than those depicted in FIG. 2 may be used. Furthermore, although the above describes adjusting the design by adjusting the angle of a slot to change the amount of energy transmitted by a slot, the interval spacing between slots may also be varied in the design to provide a different amount of energy transmitted by a slot. Moreover, FIG. 2 depicts slots 117 and 118 positioned on a surface of slotted array waveguide 115 which is not directly facing wood products 120. Such slot placement may avoid hot spots and overheating of wood product 120 when compared to a slot placement directly facing wood product 120. For example, placing slots at waveguide surface 260, which directly faces wood product 120, may cause hot spots and overheating of wood product 120.

The slots 117*a-n* may each include a window, described in more detail below. The window allows electromagnetic energy to be transmitted through a slot from the interior of slotted array waveguide 115 to chamber 110. The window also prevents contaminants from entering slotted array waveguide 115. For example, in one embodiment, the window may be formed using a piece of ceramic material. The ceramic material is electromagnetically transparent to microwave energy—thus allowing the energy to flow out of slotted array waveguide 115 to wood products 120. The ceramic material also serves as a physical barrier preventing contaminants from entering slotted array waveguide 115. A window having similar design may also be used in connection with flange 114 to couple slotted array waveguide 115 to chamber 110 and to couple chamber 110 to waveguide 137.

The microwave energy being transmitted by slots 117*a-n* through the windows of slotted array waveguide 115 provides near-field heating of wood products 120*a-c*. The spacing of the slots at about ½ wavelength intervals along the length of the waveguide may provide uniform heating of the wood products along the entire longitudinal length (e.g., axis X at FIG. 2) of slotted array waveguide 115. Slotted array waveguide 115 may be positioned about ½ inch above wood products 120*a-c* and may run the along the length of wood products 120*a-c*. In some implementations, it may be necessary to adjust the design by adjusting the interval spacing between slots 117 up to about plus or minus 1.0% of a wavelength.

Figure 3:
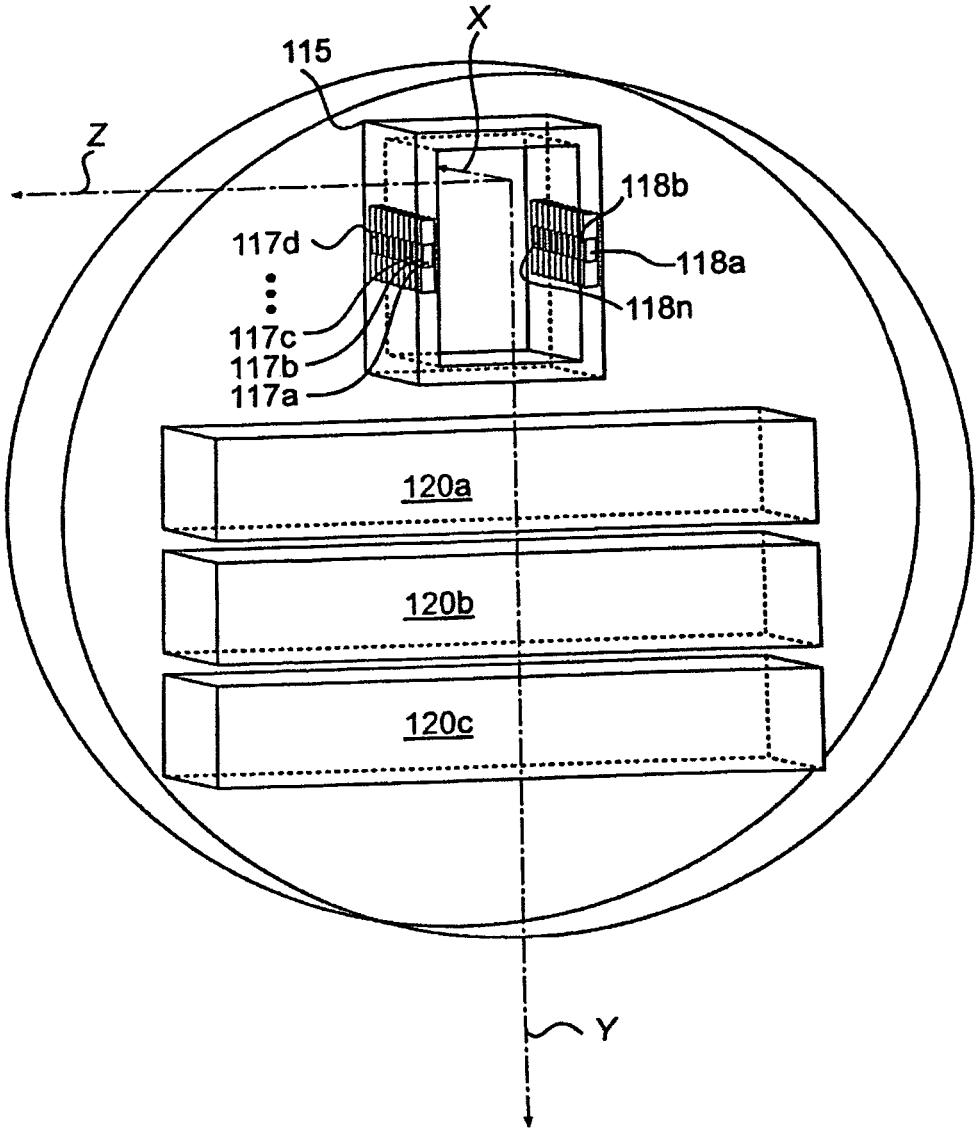
FIG. 3 is another cross section partial perspective view of the reactor of FIGS. 1 and 2.

FIG. 3 is another cross section partial perspective view of a reactor containing slotted array waveguide 115, chamber 110, and wood product 120*a-c*. Like FIG. 2, the other components contained with chamber 110 are not shown, to facilitate explanation of FIG. 3. Slots 117*a-n* are depicted on one side of slotted array waveguide 115, while the other side of slotted array waveguide 115 also includes slots 118*a-n*. When slots are used on both sides of slotted array waveguide 115, a ½ wavelength spacing between slots may be used. For example, if the first slot is slot 117*a*, the second slot 118*a* may be located on the opposite side of slotted array waveguide 115 and located about ½ wavelength longitudinally from slot 117*a*. The third slot, slot 117*b*, may be located about ½ wavelength from slot 118*a*, and on the opposite side of slot 118*a*. Although FIG. 3 depicts an alternating pattern of slots, a variety of slot arrangements be used to provide heat, depending of the specific application. Moreover, the angles associated with each of slots 117 and 118 may be the same or different. FIG. 3 also depicts windows covering slots 117 and 118. The windows are described below with respect to FIGS. 4A and 4B.

Figure 4A:
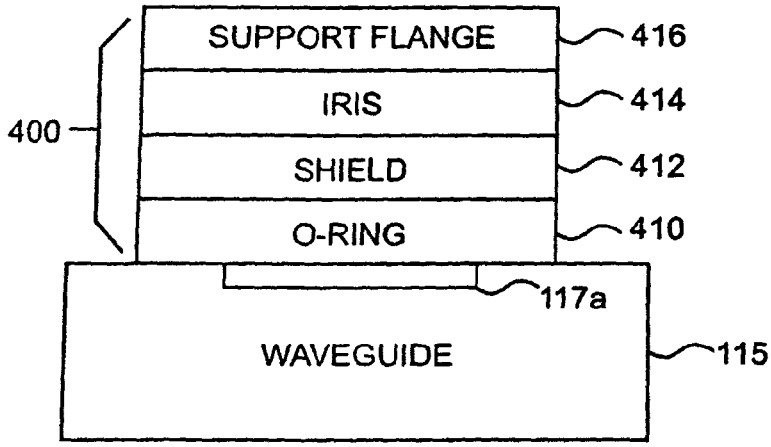
FIG. 4A is a side-view of an exemplary window assembly for the slots of the slotted array waveguide of the reactor of FIGS. 1 and 2.

FIG. 4A depicts an example window 400 which may be used at slots 117 and 118 of slotted array waveguide 115. Referring to FIG. 4*a*, window 400 includes an O-ring 410, a shield 412, an iris 414, and a support flange 416.

O-ring 410 may be implemented using rubber, plastic, or any other appropriate material that can provide a seal. For example, a perfluoroelastomers, such as Kalrez™, Chemraz™, and Simriz™, may be used as the material for O-ring 410. O-ring 410 may provide a hermetic seal between slotted array waveguide 115 and window 400. The O-ring is sized larger than the opening of a slot, and placed on top of slotted array waveguide 115, without blocking the opening of the slot. In one embodiment, a channel is cut in slotted array waveguide 115 to accommodate O-ring 410.

Shield 412 is a piece of material sized to cover one of the slots, such as slot 117*a*. Shield 412 has electromagnetic properties that allow transmission of electromagnetic energy through shield 412 with little (if any) loss. Shield 412 also prevents contaminants from traversing the window and entering slotted array waveguide 115. Shield 412 may also be strong enough to withstand the pressures used in chamber 110 and slotted array waveguide 115. In one implementation, a ceramic material, such as aluminum oxide, magnesium oxide, silicon nitride, aluminum nitride, and boron nitride, is used as shield 412. Shield 412 may be sized at least as large as the opening of the slot. In one embodiment, shield 412 may be captivated within a receptacle to accommodate screws from support flange 416.

Iris 414 provides compensation for the impedance mismatch associated with shield 412. Specifically, shield 412 may cause an impedance mismatch between the gas of slot 117*a* and ceramic shield 412. This impedance mismatch has similar electrical properties to a capacitor. Iris 414 has similar electrical properties to an inductor to compensate for the capacitive effects of the impedance mismatch. The combination of shield 412 and iris 414 effectively provide a pass band filter that compensates for the impedance mismatch at the frequency associated with slotted array waveguide 115. These capacitive and inductive effects can be modeled using software, such as HFSS™ (commercially available from Ansoft Corporation, Pittsburgh, Pa.). In one embodiment, iris 414 is implemented as a metallic device with an opening similar to slot 117*a*, although the specific dimensions of the opening of iris 414 would be determined using software, such as HFSS™, based on the circumstances, such as frequency of operation, the capacitive and inductive effects, and the like.

Support flange 416 couples iris 414, shield 412, and O-ring 410 to slotted array waveguide 115. Flange 416 may captivate the components 410-416 to slotted array waveguide 115 using a variety of mechanisms. For example, screws may be used to captivate components 410-416. The screws go though holes in support flange 416, iris 414, shield 412 (or its receptacle), and slotted array waveguide 115, although other mechanisms to captivate the components 410-416 to slotted array waveguide 115 may be used.

Figure 4B:
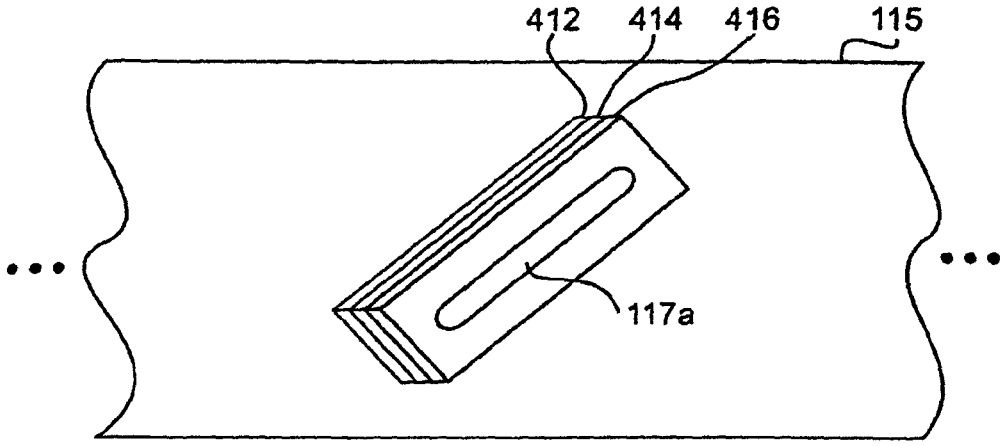
FIG. 4B is another view of the window mechanism of FIG. 4A.

FIG. 4B is another view of window 400 of FIG. 4A. A window similar in design to window 400 may also be used at flange 114. In particular, a window may be used to cap the end of slotted array waveguide 115 before being coupled to chamber 110.

As described above, slots 117 and 118 of slotted array waveguide 115 shown in FIG. 2 may have equal size, equal separation distance, and equal slanted angle. As a result, an equal portion of microwave energy is transferred through slots 117 and 118. Slots 117 and 118 also generate a reflection into slotted array waveguide 115. If slots 117 and 118 are located approximately ½ wavelength multiples from each other, these reflections will tend to cancel one another out. In general, such a cancellation would not affect the transmission of microwave energy if slotted array waveguide 115 is made of a good electrical conductor. However, in order to be compatible with a chemical process, such as acetylation of a wood product, slotted array waveguide 115 may be made of stainless steel. The electrical conductivity of stainless steel is significantly lower than that of many good electrical conductors, such as copper, silver, and aluminum. Accordingly, surface currents induced on slotted array waveguide 115 by microwave energy, particularly by multiple reflection, may cause heating of slotted array waveguide 115. The amount of heating of slotted array waveguide 115 is inversely proportional to the electrical conductivity of the material that slotted array waveguide 115 is made of. As a result, the size of slotted array waveguide 115 made of a low conductivity metal, such as stainless steel, may vary due to thermal expansion.

The effective bandwidth of slotted array waveguide 115 may be quite narrow. Accordingly, slotted array waveguide 115 may require precise design to carefully tune slotted array waveguide 115 with respect to microwave source 135. However, thermal expansion during operation may result in detuning, thus limiting the maximum power capability and microwave energy transmission efficiency of slotted array waveguide 115. An optional automatic tuner (not shown) may be added to compensate the detuning effect. However, this increases the cost and complexity of the system.

Another way to avoid de-tuning caused by thermal expansion is to limit reflections generated from slots 117 and 118. In order to so limit the reflections between each other, slots 117 and 118 may need to be formed of different sizes, different separation distances, and/or different slanted angles.

Figure 5A:
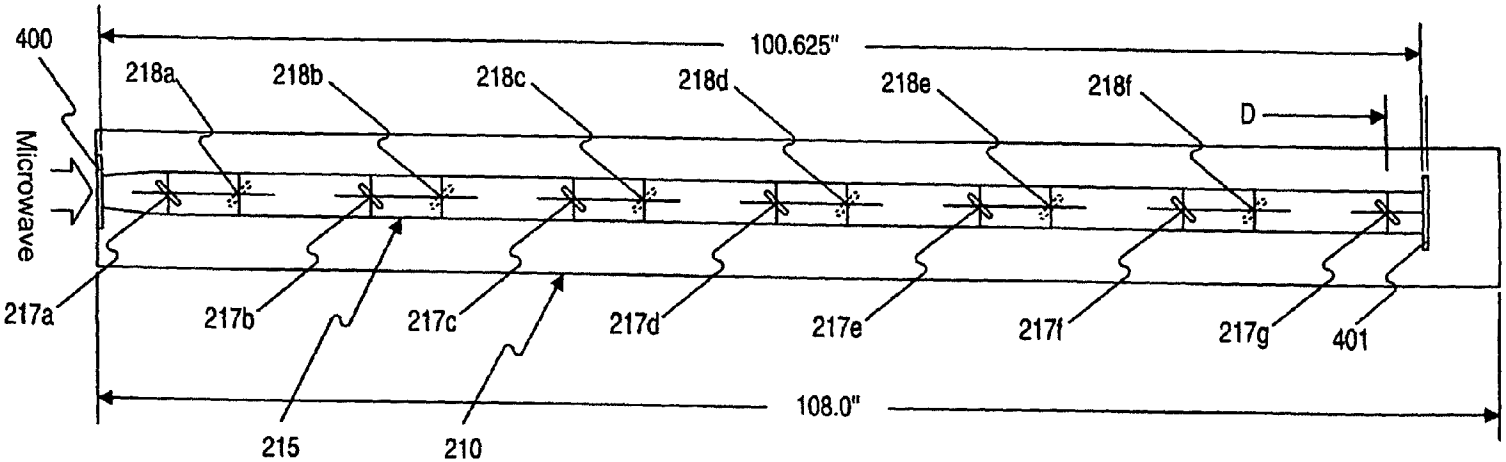
FIG. 5A is a side view of another slotted array waveguide consistent with the present invention.

FIG. 5A is a side view of another slotted array waveguide 215 consistent with the present invention. Slotted array waveguide 215, in this example, is made of stainless steel, and is sized for mounting in a chamber 210 for receiving the material being heated, such as a wood product, and for containing a chemical for processing the material. In this example, slotted array waveguide 215 has a length of 100.625 inches, and chamber 210 has a length of 108.0 inches.

As shown in FIG. 5A, slotted array waveguide 215 includes a plurality of slots 217*a-g* and 218*a-f* disposed along a longitudinal axis of slotted array waveguide 215. Slotted array waveguide 215 has a cross-section including at least two opposing sides. Slots 217*a-g* are disposed on one side (near side) of slotted array waveguide 215, while slots 218*a-f* are disposed on the opposite side (far side, slots 218*a-f* being shown in phantom) of slotted array waveguide 215. Each of slots 217*a-g* and 218*a-f* is longitudinally spaced from the left of the right-end of slotted array waveguide 215. As discussed above, slots 217*a-g* and 218*a-f* may have different sizes, different separation distances, and different slanted angles.

Microwave energy of a predetermined wavelength $\lambda$ is coupled to slotted array waveguide 215 from the left-end of slotted array waveguide 215. Slots 217*a-g* and 218*a-f* may be disposed without being covered by a window, and the left-end of slotted array waveguide 215 may be covered by a single window 400 to prevent passage of contaminants to the exterior of chamber 210. As described above, window 400 may form a physical barrier to chemicals, and yet be transparent to microwave energy. In addition, the right-end of slotted array waveguide 215 may also be covered by a window 401, or by a conductive plate.

Figure 5B:
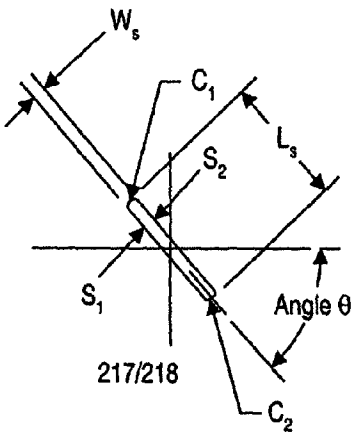
FIG. 5B illustrates a slot of the slotted array waveguide of FIG. 5A.

FIG. 5B illustrates a slot 217/218 of slotted array waveguide 215 of FIG. 5A. It is understood that slot 217/218 of FIG. 5B may represent any one of slots 217*a-g* and 218*a-f* of slotted array waveguide 215. As shown in FIG. 5B, slot 217/218 is shaped substantially as a rectangle, with rounded ends, and having a length $L_s$ and a width $W_s$. Slot 217/218 is also slanted at an angle $\theta$ with respect to the longitudinal axis of slotted array waveguide 215. In this example, slot 217/218 is a completely rounded rectangle, which consists of two congruent semicircles $C_1$ and $C_2$ having a radius of curvature R (e.g. R=0.125 inches), and two parallel lines $S_1$ and $S_2$ of equal length S connecting the two semicircles $C_1$ and $C_2$. In this example, length $L_s$ of slot 217/218 is substantially equal to the sum of length S and two times of radius of curvature R, namely $L_s$=S +2 R. In addition, width $W_s$ of slot 117/118, in this example, is substantially equal to two times of radius of curvature R, namely $W_s$=2 R.

As shown in FIG. 5A, slotted array waveguide 215, in this example, includes an odd number of slots 217*a-g* and 218*a-f* (in this example, thirteen slots). However, it is to be understood that slotted array waveguide 215 may include any desired number of slots. In order to limit reflections generated within slotted array waveguide 215, slots 217*a-f* and 218*a-f* are formed as "near-neighbor" slot pairs 217/218*a-f*. More specifically, slots 217*a* and 218*a* form a first slot pair; slots 217*b* and 218*b* form a second slot pair; slots 217*c* and 218*c* form a third slot pair; slots 217*d* and 218*d* form a fourth slot pair; slots 217*e* and 218*e* form a fifth slot pair; and slots 217*f* and 218*f* form a sixth slot pair. Slots 217*a-g* and 218*a-f* are designed such that reflection caused by each slot of a pair are canceled by reflection caused by the other slot of the pair. Slot 217*g* of slotted array waveguide 215 stands alone without forming a pair with any other slots 217*a-f* and 218*a-f*.

In this example, six slot pairs are formed. However, it is to be understood that an arbitrary number of N slot pairs may be formed in accordance with the number of slots disposed on slotted array waveguide 215.

As shown in FIGS. 5A and 5B, microwave source 135 of FIG. 1 couples microwave energy at a wavelength λ to the left end of slotted array waveguide 215, thereby delivering microwave energy into slotted array waveguide 215. Slot pairs 217/218*a-f* and slot 217*g* are each configured to transfer an equal fraction of the total microwave energy supplied to slotted array waveguide 215.

Specifically, the first slot pair 217*a*/218*a* is formed so as to transfer $1/7^{th}$ (or 1/(N+1), N=6) of the total microwave energy from slotted array waveguide 215 to the material. Consequently, $1/7^{th}$ of the total microwave energy is transferred away from slotted array waveguide 215, and $6/7^{th}$ of the total microwave energy remains in slotted array waveguide 215. The remaining microwave energy, which substantially equals $6/7^{th}$ of the total microwave energy, is transmitted further to the second slot pair 217*b*/218*b*.

Similarly, second slot pair 217*b*/218*b*, in this example, is formed so as to transfer $1/6^{th}$ of the microwave energy arriving at the second slot pair from slotted array waveguide 215 to the material being heated. Accordingly, the second slot pair transfers $1/7^{th}$ of the total microwave energy from the slotted array waveguide 215, and $5/7^{th}$ of the total microwave energy remains in slotted array waveguide 215. The remaining microwave energy, which substantially equals $5/7^{th}$ of the total microwave energy, arrives at the third slot pair 217*c*/218*c*.

The third slot pair 217*c*/218*c*, the fourth slot pair 217*d*/218*d*, the fifth slot pair 217*e*/218*e*, and the sixth slot pair 217*f*/218*f* are respectively formed so as to transfer $1/5^{th}$, $1/4^{th}$, $1/3^{rd}$, and $1/2^{nd}$ of the respective arriving microwave energy. Accordingly, each of the six slot pairs transfers away $1/7^{th}$ of the total microwave energy from slotted array waveguide 215. The remaining microwave energy, which substantially equals $1/7^{th}$ of the total microwave energy, arrives at slot 217*g*.

Finally, standalone slot 217*g* is configured to transfer all the remaining microwave energy away from slotted array waveguide 215. As a result, although slot pairs 217/218*a-f* are configured to supply into the chamber 210 an unequal fraction of arriving microwave energy, each of slot pairs 217/218*a-f* and slot 217*g* transfers an equal portion of the total microwave energy (in this example, $1/7^{th}$) away from slotted array waveguide 215 to the material being heated.

Table 1 provides exemplary lengths $L_s$, widths $W_s$, slant angles θ, and placement of slots 217*a-g* and 218*a-f* of slotted array waveguide 215 for propagating microwave of frequency 2.45 GHz.

TABLE 1

| Slot | $L_s$ (inch) | $W_s$ (inch) | Angle θ | D (inch) | Side |
|---|---|---|---|---|---|
| 217g | 2.390 | 0.25 | 48° | 3.000 | Near |
| 218f | 2.615 | 0.25 | 48° | 13.245 | Far |
| 217f | 2.615 | 0.25 | 48° | 18.560 | Near |
| 218e | 2.825 | 0.25 | 48° | 28.805 | Far |
| 217e | 2.825 | 0.25 | 48° | 34.020 | Near |
| 218d | 3.025 | 0.25 | 48° | 44.265 | Far |
| 217d | 3.025 | 0.25 | 48° | 49.480 | Near |
| 218c | 3.300 | 0.25 | 48° | 59.725 | Far |
| 217c | 3.300 | 0.25 | 48° | 64.940 | Near |
| 218b | 3.685 | 0.25 | 48° | 75.185 | Far |
| 217b | 3.685 | 0.25 | 48° | 80.400 | Near |
| 218a | 3.450 | 0.25 | 38° | 90.645 | Far |
| 217a | 3.450 | 0.25 | 38° | 95.810 | Near |

As described above, microwave energy from slotted array waveguide 115 may be used as a source of heat. Moreover, in some embodiments, the slotted array waveguide 115 may be used as a source of heat during a chemical process. For example, slotted array waveguide 115 may be used as a source of heat for the modification of a wood product by means of acetic anhydride.

The systems herein may be embodied in various forms. Although the above description describes the acetylation of wood products, the systems described herein may be used in other chemical processes and with other materials. Moreover, the systems described herein may be used to provide heat without an associated chemical process, such as acetylation. For example, the system may provide heat to dry a material, or to heat-treat a material, such as anneal, sinter, or melt. In this example, pressurized chamber 110 may not be needed since acetylation of wood is not being performed.

What is claimed is:

1. A device for heating a wood product comprising:

a waveguide propagating electromagnetic energy having a wavelength, the waveguide having a rectangular cross section and a plurality of slots along a longitudinal axis of the waveguide, the slots being disposed on alternating sides of the waveguide and slanted at an angle with respect to the longitudinal axis and spaced at periodic intervals along the longitudinal axis; and a plurality of windows covering the slots, the windows serving as physical barriers and transmitting the electromagnetic energy from inside the waveguide out of the waveguide to the wood product.

2. The device of claim 1, wherein the slots disposed on one side of the waveguide are slanted at an angle with respect to the longitudinal axis that is different from the angle at which the slots disposed on the opposite side of the waveguide are slanted with respect to the longitudinal axis.

3. The device of claim 1, wherein the slots:

are spaced at intervals of about one half of the wavelength;

have an angle between about 5 degrees and about 60 degrees with respect to the longitudinal axis; and are arranged along a surface of the waveguide not directly facing the wood product.

4. The device of claim 1, wherein the waveguide comprises:

a short-circuit terminating a first end of the waveguide; and an end window terminating a second end of the waveguide.

5. The device of claim 1, wherein:
the window comprises a shield; and
the shield comprises aluminum oxide.

6. The device of claim 1, wherein:
the window comprises a shield coupled to an iris; and
the iris includes an opening configured to compensate for a capacitive effect of the shield.

7. The device of claim 1, wherein:
the window comprises an assembly comprising a support flange, an iris, a shield, and an O-ring; and
the assembly is coupled to the waveguide.

8. A system for acetylating a wood product comprising:
a chamber sized to accommodate the wood product and formed to receive acetylation material;
a waveguide, the waveguide propagating electromagnetic energy having a wavelength, the waveguide having a rectangular cross section and a plurality of slots along a longitudinal axis of the waveguide, the slots being disposed on alternating sides of the waveguide and slanted at an angle with respect to the longitudinal axis and spaced at intervals of about one half of a wavelength along the longitudinal axis; and
a plurality of windows covering the slots, the windows serving as physical barriers and allowing the electromagnetic energy to be transferred from inside the waveguide out of the waveguide to the wood product.

9. The system of claim 8, wherein the slots disposed on one side of the waveguide are slanted at an angle with respect to the longitudinal axis that is different from the angle at which the slots disposed on the opposite side of the waveguide are slanted with respect to the longitudinal axis.

10. The system of claim 8, wherein the slots:
have an angle between about 5 degrees and about 60 degrees with respect to the longitudinal axis; and
are arranged along a surface of the waveguide not directly facing the wood product.

11. The system of claim 8, wherein the waveguide comprises:
a short-circuit terminating a first end of the waveguide; and
an end window terminating a second end of the waveguide.

12. The system of claim 8, wherein:
the window comprises a shield; and
the shield comprises aluminum oxide.

13. The system of claim 8, wherein:
the window comprises a shield coupled to an iris; and
the iris includes an opening configured to compensate for a capacitive effect of the shield.

14. The system of claim 8, wherein:
the window comprises an assembly comprising a support flange, an iris, a shield, and
an O-ring; and
the assembly is coupled to the waveguide.

15. The system of claim 8, wherein the chamber comprises a pressurized chamber.

16. The system of claim 8, wherein the wavelength comprises the wavelength being propagated by the waveguide.

17. A system for heating a material comprising:
a chamber sized to accommodate the material;
a waveguide, the waveguide propagating electromagnetic energy having a wavelength and having a rectangular cross section and a plurality of slots along a longitudinal axis of the waveguide, the slots being disposed on alternating sides of the waveguide and slanted at an angle with respect to the longitudinal axis and spaced at intervals of about one half of a wavelength along the longitudinal axis; and
a plurality of windows covering the slots, the windows serving as physical barriers and transmitting the electromagnetic energy from inside the waveguide out of the waveguide to the material.

18. A method of heating a material contained within a chamber, the chamber further containing a waveguide, the waveguide propagating electromagnetic energy having a wavelength and having a rectangular cross section and a plurality of slots along a longitudinal axis of the waveguide, the slots being disposed on alternating sides of the waveguide and slanted at an angle with respect to the longitudinal axis and spaced at an interval along the longitudinal axis, and wherein a plurality of windows cover the slots, the windows serving as physical barriers and transmitting the electromagnetic energy from inside the waveguide out of the waveguide to form a near field, the method comprising:
placing the material within the near-field of the waveguide; and
supplying electromagnetic energy to the waveguide to heat the material contained within the chamber.

19. A system for heating a wood product comprising:
a chamber for receiving the wood product and for containing a chemical for processing the wood product;
a waveguide propagating electromagnetic energy having a wavelength, the waveguide having a rectangular cross section and a plurality of slots disposed along a longitudinal axis of the waveguide and on alternating sides of the waveguide and being configured such that the slots transmit the electromagnetic energy from inside the waveguide to the chamber, but that not all of the slots supply equal amounts of the energy through the slots into the chamber; and
at least one window forming a barrier to the chemical and transmitting the energy.

20. A system as recited in claim 19, wherein the slots disposed on one side of the waveguide are slanted at an angle with respect to the longitudinal axis that is different from the angle at which the slots disposed on the opposite side of the waveguide are slanted with respect to the longitudinal axis.

21. A system as recited in claim 20, wherein:
the slots comprise a plurality of slot pairs;
and wherein for each of the pairs:
one slot of the pair is disposed on one of the two sides; and each slot of the pair is configured so as to cancel the energy reflections generated by the other slot of the pair.

22. A system as recited in claim 21, wherein:
the waveguide comprises N slot pairs and an end slot;
each of the slot pairs is configured to transfer into the chamber a fraction of the energy equal to 1/(N+1); and
the end slot is configured so as to transfer into the chamber a fraction of the energy equal to 1/(N+1).

23. A system as recited in claim 21 wherein at least one of the slots is disposed without a window.

24. A system as recited in claim 19, wherein the waveguide comprises stainless steel.

* * * * *